US006330813B2

(12) United States Patent
Patel et al.

(10) Patent No.: US 6,330,813 B2
(45) Date of Patent: Dec. 18, 2001

(54) BLOWER WITH ORIFICE CLEARING MEMBER FOR LIFTING INSULATION PACK

(75) Inventors: Mayur M. Patel, Columbus; Timothy A. Walsh, Newark, both of OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/790,074

(22) Filed: Feb. 21, 2001

Related U.S. Application Data

(62) Division of application No. 09/425,391, filed on Oct. 22, 1999, now Pat. No. 6,244,075.

(51) Int. Cl.[7] ..... F27B 1/26
(52) U.S. Cl. ..... 65/483; 406/198
(58) Field of Search ..... 426/198

(56) References Cited

U.S. PATENT DOCUMENTS

| | | |
|---|---|---|
| 2,988,469 | 6/1961 | Watson . |
| 4,280,253 | 7/1981 | Holt . |
| 4,292,365 | 9/1981 | Kane et al. . |
| 4,463,048 | 7/1984 | Dickson et al. . |
| 4,551,378 | 11/1985 | Carey, Jr. . |
| 4,640,082 | 2/1987 | Gill . |
| 4,716,712 | 1/1988 | Gill . |
| 5,014,396 | 5/1991 | Nieminen . |
| 5,088,959 | 2/1992 | Heemskerk . |
| 5,302,220 | 4/1994 | Terakawa et al. . |
| 5,624,742 | 4/1997 | Babbitt et al. . |

*Primary Examiner*—Christopher P. Ellis
*Assistant Examiner*—Joe Dillon, Jr.
(74) *Attorney, Agent, or Firm*—Inger H. Eckert; Stephen W. Barns

(57) ABSTRACT

Apparatus for manufacturing fibrous insulation includes a porous conveyor mounted for transporting fibrous material in a machine direction in the form of pack. A pack lift blower is positioned beneath the porous conveyor, in a direction transverse to the machine direction, to direct gases upwardly through the porous conveyor to fluff the fibers within the pack. The pack lift blower has a nozzle that is readily removable and replaceable for cleaning without requiring interruption in the motion of the conveyor. The nozzle may also include slots which allow the passage of air and a reciprocal member which cleans the slots.

3 Claims, 4 Drawing Sheets

BLOWER WITH ORIFICE CLEARING MEMBER FOR LIFTING INSULATION PACK

CROSS REFERENCE TO RELATED APPLICATION(S)

This is a division of U.S. patent application Ser. No. 09/425,391 filed Oct. 22, 1999 now U.S. Pat. No. 6,244,075 hereby incorporated by reference.

TECHNICAL FIELD AND INDUSTRIAL APPLICABILITY OF THE INVENTION

This invention relates to the production of fibrous insulation products, and more particularly to the handling of fibrous insulation material after the material has been deposited onto a forming conveyor and prior to the forming of the insulation material into an insulation product.

BACKGROUND OF THE INVENTION

The manufacturing of fibrous insulation products involves making insulation fibers and transforming them into insulation products. Mineral fiber insulation material, for example, is produced by first forming mineral fibers from molten mineral material, such as molten glass, rock, slag or basalt. Numerous fiber forming processes, such as a rotary process with a rotating spinner, a spintex process with a series of parallel drums, or a superfine process where primary glass streams are blasted into fibers by the action of jets of hot gases, can be used to form the mineral fibers. Fibrous insulation products are usually held together by a binder material such as urea phenol-formaldehyde. During the manufacturing process the insulation material, with the binder material applied, is passed through an oven where the binder material is dried and then elevated in temperature to cause the binder material to be cured thereby bonding the fibers together where the fibers intersect with each other. Typical binder curing ovens involve upper and lower continuously moving oven chains that are spaced apart a specified distance to define the thickness of the ultimate mineral fiber product. The oven chains are perforated or foraminous and hot air flows through both the oven chains and the insulation material to cure the binder.

In a typical fiber forming process the fibers are deposited from several fiberizing devices to form a wool pack on a perforated or foraminous conveyor, referred to as a forming chain, which is mounted for travel within a forming chamber. The forming chamber has sidewalls and endwalls, and is provided with suction boxes beneath the forming chain to help pull the insulation fibers down onto the forming chain which forms the insulation pack. Because of the high downward flow of air associated with the fiberizing process, a strong suction force is required to draw the mineral fibers onto the forming chain and prevent the fibers from remaining airborne in the air currents within and surrounding the forming chamber. The suction boxes also help evenly distribute the insulation material across the width of the forming chain so that the subsequent insulation products are generally uniform in density and thickness in the width or transverse direction.

The suction forces required to assure that the mineral fibers remain on the forming chain are often so strong that it is difficult for the insulation material to completely expand or spring up to a desirable height after the wool pack travels beyond the suction boxes. Excessive moisture in the pack prevents the pack from expanding to the desired height. It is preferred to have the wool pack to be expanded to a full, unrestrained height that is greater than the spacing between oven chains prior to entering the oven so that the full height of the cured insulation product can be realized. To achieve the desired expansion of the wool pack prior to the pack's entering the curing oven, it is typical for a pack lift blower to be positioned outside the forming area and beneath the forming chain. The pack lift blower directs air upward through the foraminous forming chain to fluff up the pack and assist the fibers in the pack to recover from the compression during the fiber collecting process. Further, the pack lift blower also has the added dividend of providing beneficial lateral or transverse fiber distribution.

A typical pack lift blower involves a supply of pressurized air from a fan or other source. The pressurized air is supplied via a duct to a nozzle that is flared out to change in cross-sectional shape from a supply conduit, such as an 8 inch diameter circular duct, to an elongated slot positioned directly beneath the forming chain and having a length extending across (i.e., transverse to the machine direction) the underside of the forming chain.

A problem with pack lift blowers is that the they become plugged with fibers and binder material that accumulate on the nozzle outlet. Fibers and binder material reach the nozzle by dropping down through the traveling forming chain, by being sprayed by errant binder sprays, by the accumulation of air-borne fibers and binder drops, and possibly even by condensation of binder material. Eventually, the nozzle outlet becomes so plugged with accumulated binder and fibers that the pack lift blower can no longer perform its function of fluffing up the pack. This leads to a reduction in the recovery value of the insulation product when the insulation package is opened after compression packaging, transport and storage. Stopping the fiber glass insulation production line to clean out the nozzle is an unattractive solution because of the lost value of the production time. Accordingly, it would be valuable if there could be developed a system for maintaining the integrity of the opening of the nozzle for the pack lift blower without requiring shutting down the manufacturing equipment.

SUMMARY OF THE INVENTION

The above objects as well as other objects not specifically enumerated are achieved by apparatus for manufacturing fibrous insulation comprising a porous conveyor mounted for transporting fibrous material in a machine direction in the form of pack. A pack lift blower is positioned beneath the porous conveyor, in a direction transverse to the machine direction, to direct gases upwardly through the porous conveyor to fluff the fibers within the pack. The pack lift blower has a nozzle that is readily removable and replaceable for cleaning without requiring interruption in the motion of the conveyor.

In another embodiment of the invention, there is provided apparatus for manufacturing fibrous insulation comprising a porous conveyor mounted for transporting fibrous material in a machine direction in the form of pack. A pack lift blower is positioned beneath the porous conveyor, oriented in a direction transverse to the machine direction, to direct gases upwardly through the porous conveyor to fluff the fibers within the pack. The pack lift blower has a nozzle including a series of elongated slots. Movable members are positioned within the slots and mounted for reciprocation along the length of the slots to maintain the slots in an open condition.

In yet another embodiment of the invention, there is provided a method of manufacturing fibrous insulation comprising transporting fibrous material in the form of a pack on a porous conveyor in a machine direction. A pack lift blower is positioned beneath the porous conveyor and in a direction transverse to the machine direction. The pack lift blower has a nozzle that is readily removable and replaceable for cleaning without requiring interruption in the motion of the conveyor. The pack lift blower directs gases upwardly through the porous conveyor to fluff the fibers within the pack; and the nozzle is removed for cleaning without interrupting the motion of the conveyor.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

While the description and drawings disclose insulation products of fiberglass insulation, it is to be understood that the insulation material can be any compressible fibrous insulation material, such as rock wool or other mineral fibers, or such as polyethylene or other organic fibers.

Figure 1:
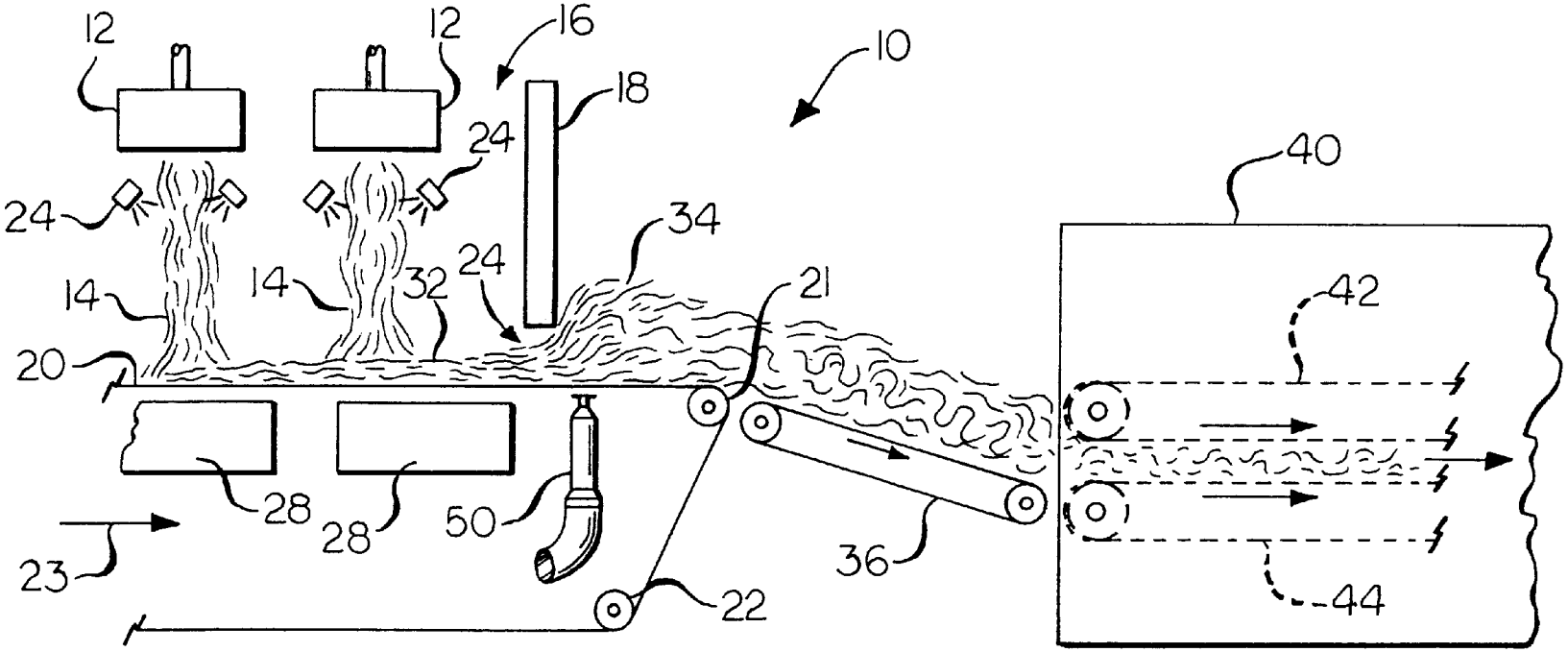
FIG. 1 is a schematic view in elevation of a fiberglass insulation production machine.

As shown in FIG. 1, the apparatus for manufacturing fiber glass insulation is indicated generally at 10. A plurality of rotary fiberizers 12 form glass fibers and direct them downwardly in the form of veils 14 of fibers and gases. The rotary process for forming glass fibers in this manner is well known in the art. The fiberizers are positioned within a forming chamber 16 defined by sidewalls, not shown, and endwalls 18, only one of which is shown. Positioned beneath the fiberizers 12 is a porous collection conveyor, such as forming chain 20, that is mounted for travel about the upper head shaft sprocket 21 and lower head shaft sprocket 22 in a machine direction 23. Forming chains are typically made of stainless steel, and are foraminous or porous so that air or other gases can be blown or sucked through the forming chain.

Surrounding the veils 14 are nozzles 24 that spray a binder material, such a water based urea phenol-formaldehyde binder onto the fibers. Water sprays, not shown, can also be used to cool the fibers and hot gases prior to the introduction of the binder. The fibers from the veils 14 accumulate on the forming chain 20 and form a pack 26 which is an unbonded collection of fibers. Positioned beneath the forming chain 20 are several suction boxes 28 that are connected to a source of vacuum, not shown. The suction boxes draw air through the porous forming chain and thereby force the glass fibers to remain on the forming chain rather than fly about the forming chamber. It can be seen that the suction boxes cause a substantial compression of the fibers in the first or upstream portion 32 of the pack 26. In contrast, after the pack 26 passes the last of the suction boxes 28, the pack, freed from the compressive forces of the downward air flow through the forming chain, expands in a downstream portion 34 of the pack. Thereafter, the pack leaves the forming chamber 16 and travels along a ramp conveyor 36 to the oven 40. In the oven, upper and lower oven chains 42 and 44, respectively, maintain the glass fibers at a constant predetermined thickness while the binder material in the pack is dried and then cured by hot air.

In order to assure that maximum loft or expansion of the pack occurs as the forming chain 20 travels beyond the last of the suction boxes 28, a pack lift blower 50 is positioned beneath the forming chain just downstream from the last suction box 28, and just downstream from the endwall 18. The purpose of the pack lift blower is to fluff the pack by blowing air upwardly through the forming chain 20. The force of the upward flow of air helps separate some of the fibers stuck together by the action of the suction boxes, thereby enabling the collection of fibers in the downstream portion 34 of the pack to achieve a greater degree of loft than would otherwise occur. The air flow also fluffs the pack by jostling the fibers, thereby enabling some of the fibers held in a strained fiber-to-fiber condition or relationship to be released from the strained relationship and thereby further expand the pack.

Figure 2:
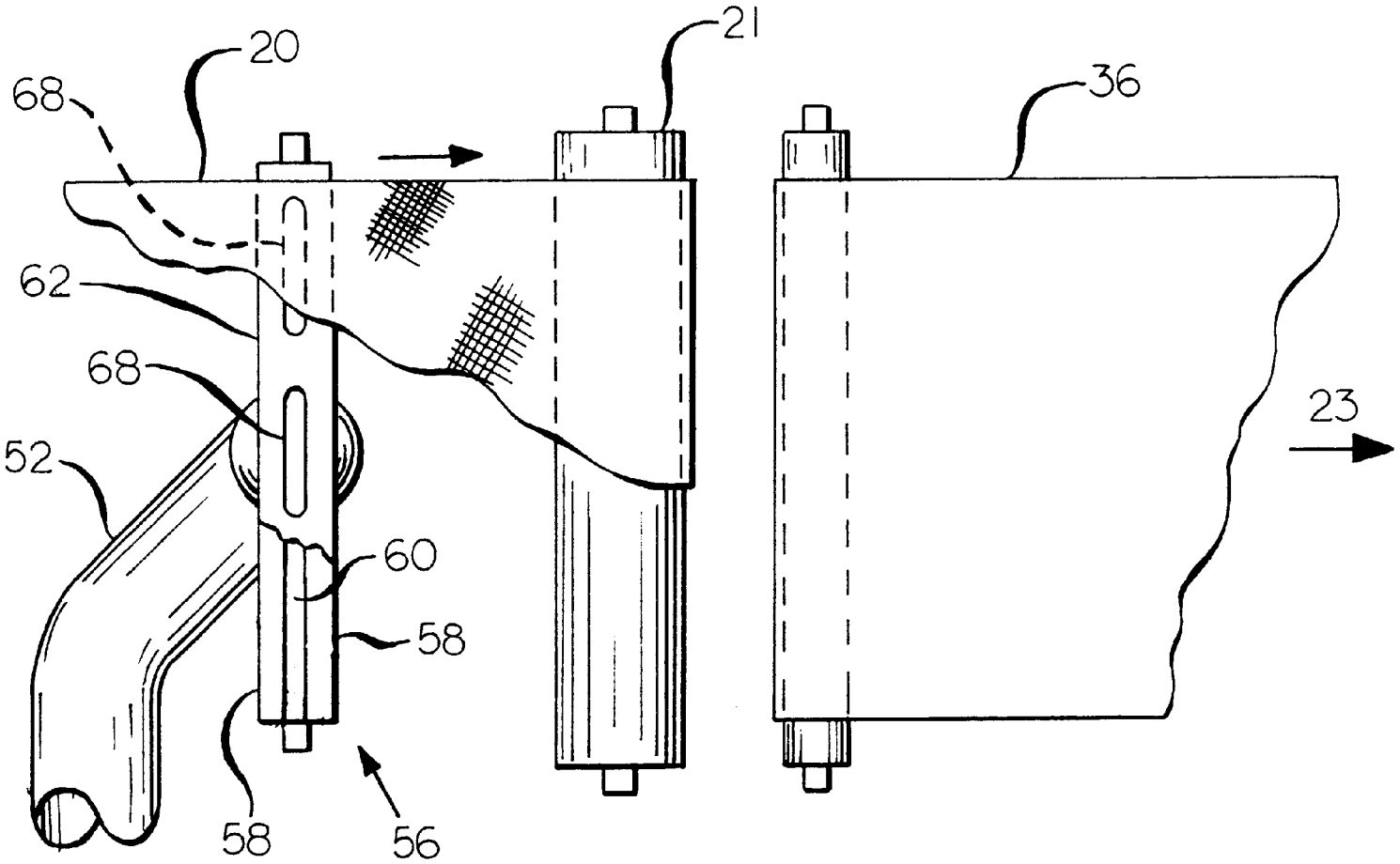
FIG. 2 is a schematic plan view, partially cut away, of a portion of the fiber collecting equipment of FIG. 1, including the pack lift blower used with the invention.
Figure 3:
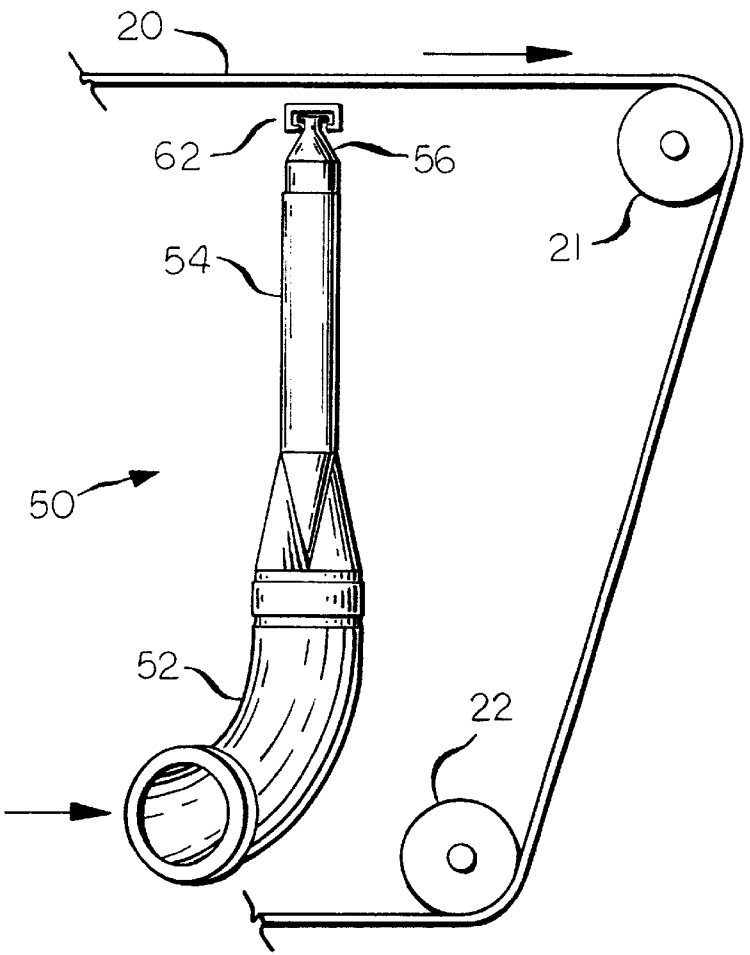
FIG. 3 is an enlarged elevational view of the pack lift blower.

As shown more clearly in FIGS. 2 and 3, the pack lift blower 50 is comprised of a supply duct 52 that supplies air from a source of pressurized air, such as a fan, not shown. The pack lift transition duct 54 has a varied cross-sectional shape. The shape of duct 54 changes from a circular duct at its bottom end to a wide slot-shaped duct extending transversely across the forming chamber 16 at its top end. At the top of the pack lift transition duct 54 is a reducing portion, such as reducer 56, shown more clearly in FIG. 5. The reducer 56 has a pair of outwardly oriented, opposed flanges 58 that define an open throat 60. The air exiting the throat travels upwardly through the forming chain 20 to fluff the pack. It is to be understood that various configurations, shapes and sizes of the pack lift blower 50 can be used with the invention.

Figure 5:
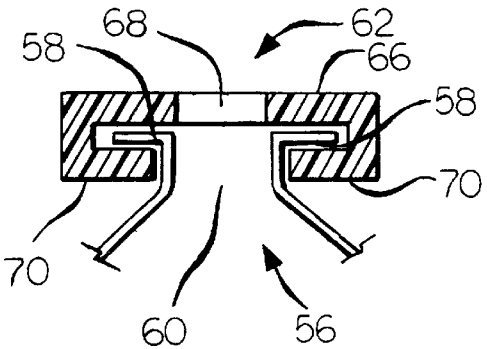
FIG. 5 is a schematic cross-sectional view in elevation of the nozzle of FIG. 4, taken along line 5—5, with the addition of a portion of the pack lift blower reducer.
Figure 4:
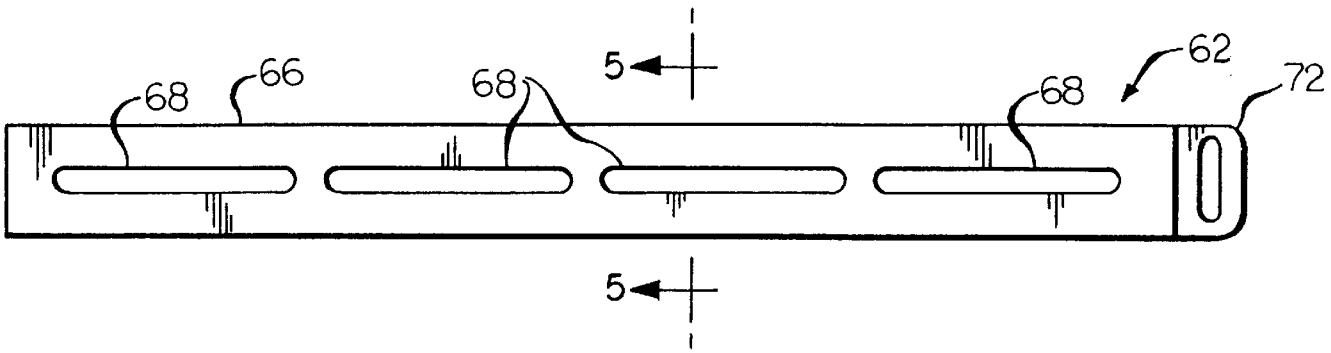
FIG. 4 is schematic plan view of the nozzle of the invention.

Positioned on top of the reducer 56 is a nozzle 62. The nozzle 62 forms a restriction on the amount of air flow that can exit from the throat 60 of the reducer, thereby establishing the velocity and flow characteristics of the upwardly directed flow of air. As shown in FIGS. 4 and 5, the nozzle is comprised of a central web 66 that is a plate-like member having the shape of a flat plate, although other shapes can be used with the invention. The nozzle 62 also includes a series of elongated slots 68 that extend along the length of the central web 66 and define the openings through which the air exits the pack lift blower 50. Although four slots 68 are shown, any number of slots can be used. The size and number of the slots can be varied to affect the velocity of the air exiting the pack lift blower. In general, a higher velocity air flow is used with a higher square foot weight insulation product. The advantage of using a readily removable and replaceable nozzle is that to some extent the nozzle characteristics can be tailored to meet the requirements of different products produced on the machine.

As shown in FIG. 5, the nozzle is provided with opposed retainer flanges 70 adapted to engage the opposed throat flanges 58 on the reducer element 56. The combination of the opposed throat flanges 58 of the reducer element 56 in engagement with the opposed retainer flanges of the nozzle provides a mechanism allowing the nozzle to slide with respect to the pack lift blower 50. This enables the nozzle to be readily removable and replaceable for cleaning without requiring interruption of the motion of the forming chain 20, and without requiring a cessation of the insulation manufacturing process.

In operation, the nozzle 62 is periodically removed from the pack lift blower 50 for cleaning. This can be at any desirable interval, such as daily. A handle 72 can optionally be provided to expedite removal of the nozzle from beneath the forming chain 20. To facilitate cleaning, the nozzle 62 is preferably made of a smooth polymeric material, such as an ultra high molecular weight (UHMW) polyethylene material, an example of which is UHMW 819 by Ryerson. When the nozzle is removed daily for cleaning, the cleaning operation is accomplished in very little time. A second nozzle can be inserted on the pack lift blower during the cleaning of the first nozzle.

Figure 6:
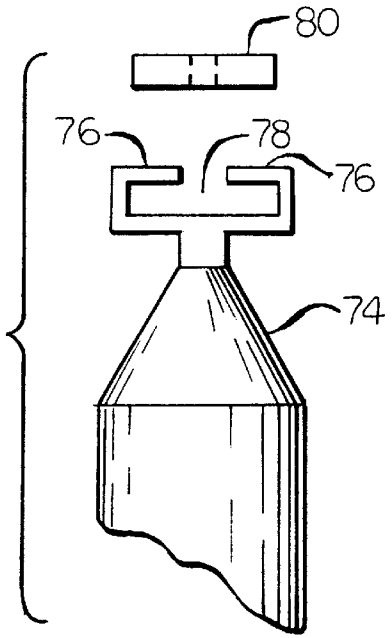
FIG. 6 is a schematic view in elevation of an alternate embodiment of the invention.

In another embodiment of the invention, shown in FIG. 6, a reducing portion, such as reducer 74, similar to the reducer 56 illustrated in FIGS. 3 and 5, is provided with opposed retainer flanges 76 that are inwardly curved or bent to define a slot or cavity 78 suitable for engaging and receiving a nozzle 80 that does not have its own opposed retainer flanges.

Figure 7:
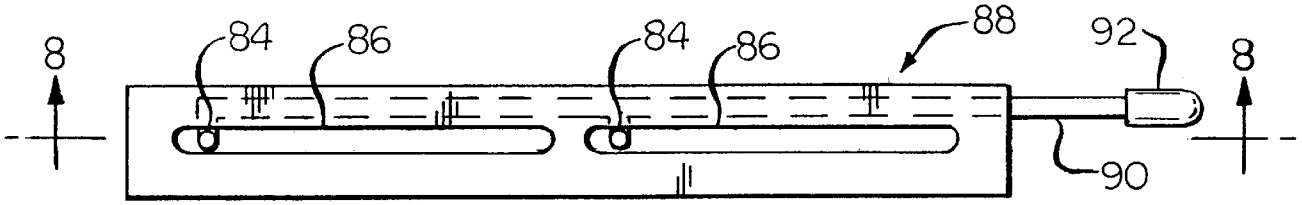
FIG. 7 is a schematic plan view of yet another embodiment of the invention.
Figure 8:
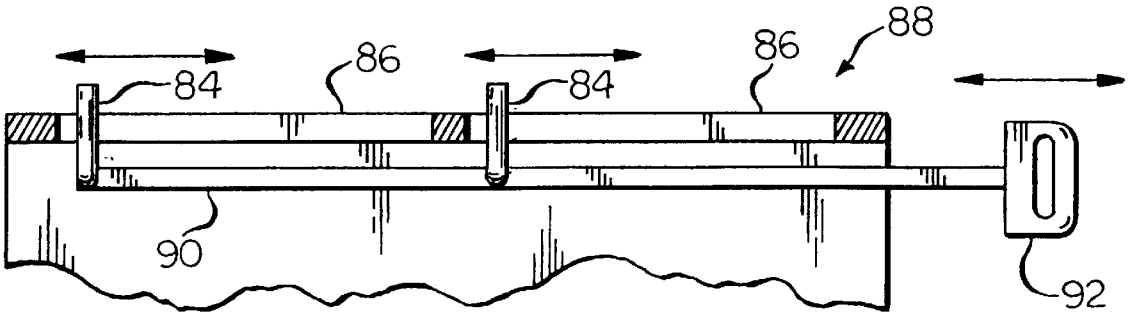
FIG. 8 is a schematic cross-sectional view in elevation of the invention illustrated in FIG. 7, taken along line 8—8.

In yet another embodiment of the invention, shown in FIGS. 7 and 8, movable members, such as pins 84 are positioned within slots 86 of nozzle 88 and mounted for reciprocation along the length of the slots to maintain the slots in an open condition. The nozzle comprises a plate-like member in which the series of slots 86 are positioned. The pins 84 can be mounted for reciprocation in any suitable manner, but are preferably vertically oriented pins attached to a transversely oriented connecting rod 90 that can be reciprocated in the transverse direction to reciprocate the pins 84 in unison along the length of the slots 86. The pins 84 and connecting rod 90 are preferably made of hardened steel, although other material can be used. It is to be understood that the moveable members are not limited to pins, but could be bars, scraper blades air nozzles, or other equipment suitable for removing accumulated glass fibers and binder material from the slot. The connecting rod 90 can be provided with a handle 92 to use when reciprocating the rod 90 and pins 84. The nozzle 88 is mounted on the top of the pack lift blower 50. The ability to clean out the slots 86 and maintain them in an open condition at any time without shutting down the insulation machine assures that the upward flow of air from the pack lift blower will be maintained throughout the operation of the insulation machine.

The principle and mode of operation of this invention have been described in its preferred embodiments. However, it should be noted that this invention may be practiced otherwise than as specifically illustrated and described without departing from its scope.

What is claimed is:

1. Apparatus for manufacturing fibrous insulation comprising a porous conveyor mounted for transporting fibrous material in a machine direction in the form of pack, and a pack lift blower oriented in a direction transverse to the machine direction and positioned beneath the porous conveyor to direct gases upwardly through the porous conveyor to fluff the fibers with the pack, wherein the pack lift blower has a nozzle including at least one elongated slot, and further including movable members positioned within the slots and mounted for reciprocation along the length of the slots to maintain the slots in an open condition.

2. The apparatus of claim 1 in which the nozzle comprises a plate-like member in which the slots are formed.

3. The apparatus of claim 1 in which the movable members comprise vertically oriented pins attached to a transversely oriented connecting rod that can be reciprocated in the transverse direction to reciprocate the pins in unison along the length of the slots.

* * * * *